United States Patent [19]

Wölflingseder et al.

[11] 4,322,926

[45] Apr. 6, 1982

[54] FRAME FOR SPACING GLASS PANES

[75] Inventors: Hermann Wölflingseder; Werner Wölflingseder, both of Feldkirch, Austria

[73] Assignee: Seraphin Pumpell & Söhne KG, Feldkirch, Austria

[21] Appl. No.: 104,690

[22] Filed: Dec. 17, 1979

[51] Int. Cl.[3] ..... E06B 7/12

[52] U.S. Cl. ..... 52/172; 52/398; 52/631

[58] Field of Search ..... 52/172, 631, 788, 731, 52/397–399

[56] References Cited

U.S. PATENT DOCUMENTS

| | | | |
|---|---|---|---|
| 2,419,400 | 4/1947 | Haven | 52/172 |
| 3,380,145 | 4/1968 | Stroud et al. | 52/172 |
| 3,540,118 | 11/1970 | Hughes | 52/172 |
| 4,109,432 | 8/1978 | Pilz | 52/172 |

FOREIGN PATENT DOCUMENTS

| | | | |
|---|---|---|---|
| 1006052 | 1/1977 | Canada | 52/172 |
| 2160847 | 6/1973 | Fed. Rep. of Germany | 52/172 |

*Primary Examiner*—J. Karl Bell

*Attorney, Agent, or Firm*—Toren, McGeady & Stanger

[57] ABSTRACT

In making a spacing frame for use in forming an insulated arrangement of spaced glass panes, the frame is made from a continuous length of a tubular bar arranged to contain desiccant granules of given size. A wall section of the tubular bar, which is to form the inner frame border between the glass panes, is cut transversely of the longitudinal axis of the tubular bar. The depth of each cut is selected to be substantially equal to the thickness of the wall section. The width of each cut in the direction of the longitudinal axis of the tubular bar is selected so the desiccant granules cannot escape through the cut, and sections of the bar extending longitudinally from opposite sides of the cuts are bent relative to one another to form the frame corners.

5 Claims, 12 Drawing Figures

FRAME FOR SPACING GLASS PANES

BACKGROUND OF THE INVENTION

The present invention relates to manufacturing a spacing frame for use in forming an insulated arrangement of spaced glass panes from a continuous length of a tubular bar containing granules of hygroscopic or dessicant material of given size. The bar has a wall section forming the inside border surface of the frame, the wall section having openings or passages communicating between the hygroscopic material in the bar and the region between the spaces panes. In particular, the invention is directed to forming corners of the spacing frame by cutting the wall section in a direction transverse to the longitudinal axis of the bar, and bending the bar sections extending between the cuts relative to each other to form the frame corners.

Various frames for spacing glass panes to form an insulated arrangement of spaced glass panes are known and disclosed, for example, in U.S. Pat. Nos. 3,540,118 and 3,380,145, and Canadian Pat. No. 1,006,052. The spacing frames are usually made of relatively light weight metal bar sections. The bar sections may be provided in lengths corresponding to sides of the finished frame, the frame being formed by joining the individual bar sections together by way of special corner connectors or pieces provided at the frame corners, as disclosed in Canadian Pat. No. 1,006,052. The ends of the separate bar sections may abut each other at the frame corners. Further, miter cuts can be made transverse to the longitudinal direction of a tubular bar of given length, thereby forming connected bar sections which can be bent at the miter cuts to form the frame corners, the ends of the tubular bar being joined by a single connecting piece. Such a construction is disclosed in U.S. Pat No. 3,380,145.

The tubular bar sections of the known spacing frames each contain granules of hygroscopic or desiccant material, this material being well known and commercially available. Slots or perforations are provided in the wall sections of the bars which face the region between the glass panes to allow the desiccant material to absorb moisture from this region. The spacing frame corners, whether formed by butt-joining of the bar sections, using a miter cut, or by the use of separate corner pieces, are considered to be weak points in an insulating glass assembly, requiring careful working and special processing. Nevertheless, the known corner joints have been the subject of complaints, particularly in insulating glass pane assemblies which are exposed to extreme environments, for example, swimming pool enclosures or workshop areas.

German Pat. No. 2,160,847 discloses an insulating glass assembly which consists of two or more glass panes and a spacing frame arranged between the edges of the panes. The pane edges are joined to the spacer with a plastic compound, and the spacer has a bore extending longitudinally therein for containing a desiccant. A number of openings are provided in the spacer communicating between the longitudinal bore and the surface of the spacer which faces the region between the glass panes. The spacer forms the central longitudinal portion of a rigid bar, the bar having longitudinally extending grooves in its sides for receiving the edges of the glass panes. The bar therefore has a substantially U-shaped cross-section, the central portion of which includes the spacer with its central bore.

Assembly of the insulating glass assembly of German Pat. No. 2,160,847 is effected by inserting the edges of the glass panes into the outer grooves of the bar, and pressing the sides of the bar which bound the grooves against the glass panes. Such assembly is difficult, if not impossible, to realize in practice. For example, in order to properly seal the glass panes to the rigid bar including the spacer, the sides of the bar must be pressed against the panes. This pressing or rolling of the sides of the bar generally results in breakage of the glass panes. Also, this patent discloses the cutting of the bar in the form of a V at locations corresponding to the corners of the frames to be formed, and then bending the individual connected bar sections relative to each other. The bar is cut down to its base so that it is cut in V form over nearly its entire height at the corner regions to obtain a substantially mitered joint. This method of forming the frame corners is also undesirable due to the presence of the granules of desiccant provided in the central bore of the spacer portion of the bar. As soon as the V cuts are made, and the bar sections thus formed are handled to form the frame, the desiccant within the spacer portion of the bar will spill out from the central bore in the spacer, the bore having been opened to the outside by the V cuts. Inasmuch as a spacing frame for insulating glass panes must include desiccant to prevent moisture from forming on the inner surfaces of the glass panes, this method is, once again, not suitable.

An object of the present invention is to overcome the above and other shortcomings in the prior spacing frames.

Another object of the present invention is to provide a method of preparing tubular bars filled with granules of hygroscopic or desiccant material so that they can be bent to form spacing frames without providing V-shaped miter cuts in the bar.

In accordance with the present invention, a method of manufacturing a frame for use in forming an insulated arrangement of spaced glass panes from a continuous length of a tubular bar containing granules of hygroscopic material material of a given size includes cutting the wall section of the bar which is to form an inner frame border extending between the glass panes in a direction transverse to the longitudinal axis of the bar. The depth of each cut is selected to correspond substantially to the thickness of the wall section, and the width of each cut in the direction of the longitudinal axis of the bar is selected so that the granules of desiccant can not escape out through the cuts.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
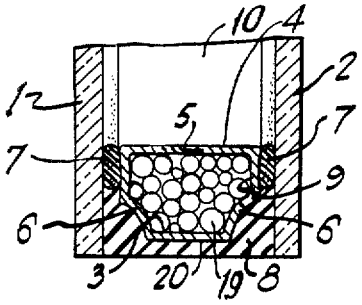
FIG. 1 is a cross-sectional view through an edge of an insulating glass assembly including a spacing frame.

In FIG. 1, two glass panes 1 and 2 are spaced from each other by a spacing frame 3 which is made of relatively light weight metal tubular bar or element 20. The bar 20 as shown in FIG. 1 is known in the art. Bar 20 has a wall section 4 which forms the inside border of the frame 3, wall section 4 having slots or passages 5 formed in a central longitudinal joint thereof. Bar 20 has side walls 6 which extend in a concave manner from the wall section 4 and then bend toward each other to join another wall section which forms the outside border of the frame 3.

A permanent elastic sealing and adhesive compound 7 is applied between the side walls 6 in the region of the wall section 4 and the inner surfaces of the glass panes 1 and 2 to ensure proper bonding of the glass panes to the frame 3. A permanent, elastic sealing compound 8 is provided between the inner surfaces of the glass panes 1 and 2 in the region of the outside border of the frame 3. All bars which can be used in the manufacture of the spacing frame 3 are tubular bars or elements, each having a hollow interior region 9. A hygroscopic or desiccant material 19 is provided in the region 9 of the bar 20, this material absorbing moisture from a region 10 between glass panes 1 and 2 through the passages 5 formed in the longitudinal joint in the wall section 4 of the bar 20. The desiccant is commercially available in the form of granules about 1 to 2 mm in diameter.

Figure 2:
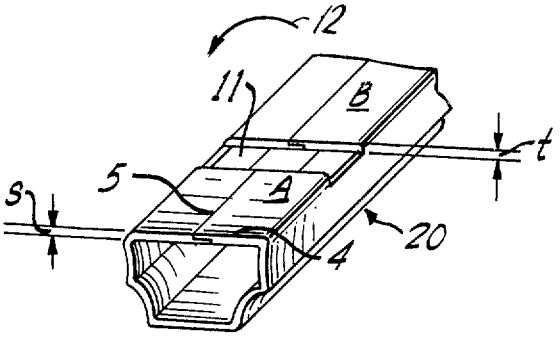
FIG. 2 is a perspective view of a part of a tubular bar having a cut therein according to the present invention.
Figure 3:
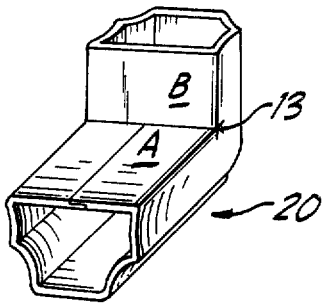
FIG. 3 is a perspective view of the tubular bar in FIG. 2 after it has been bent to form a frame corner.
Figure 5:
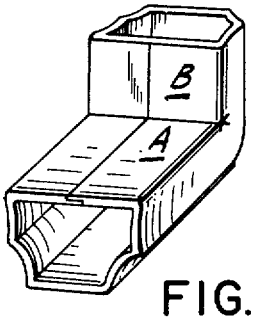
FIG. 5 is a perspective view of the bar in FIG. 4 after it has been bent to form a frame corner.

The manufacture of the spacing frame 3 begins with the selection of the tubular bar 20 which has a length corresponding to the perimeter of the spacing frame to be produced. At those locations where the frame corners are to be formed, the bar 20 is cut in a direction transverse to its longitudinal axis through the wall section 4, as shown in FIG. 2. The depth t of the cut 11 corresponds at least to the thickness s of the section 4. Thereafter, sections A and B of the bar 20 which extend longitudinally from the edges of the cut 11 are bent relative to each other as indicated by arrow 12, thus forming a frame corner as shown in FIG. 3. In accordance with this method, the sides 13 of the frame corners are not significantly deformed, and no bulging occurs in the region of the sides. During bending of the bar 20, the corners including the sides 13 are carefully guided in an appropriate tool to prevent bulging of the sides 13 at the corners.

Figure 4:
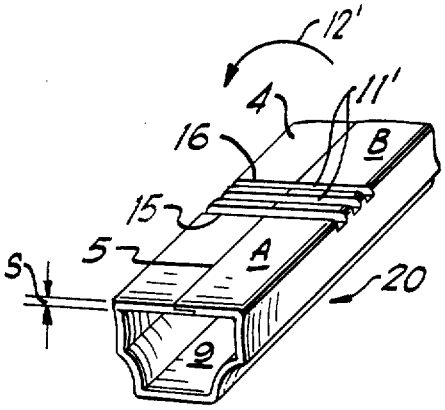
FIG. 4 is a perspective view of part of a tubular bar having a number of cuts made therein according to the present invention.
Figure 6:
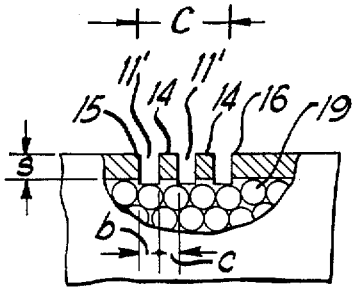
FIG. 6 is an enlarged side view, partly in longitudinal cross-section, of the tubular bar in FIG. 4 in the region of the cuts.

The present method also contemplates the provision of several, preferably three, cuts 11′ transversely of the wall section 4 where a corner is to be formed, as shown in FIGS. 4 and 6. Webs 14 are thus provided between the individual cuts 11′. The width or extent b of each of the individual cuts 11′ in the direction of the longitudinal axis of the bar 20 is substantially equal to the width or axial extent c of each of the webs 14. The depth of the cuts 11′ is preferably selected to be slightly greater than that of the thickness s of the wall section 4 of the bar 20.

Figure 7:
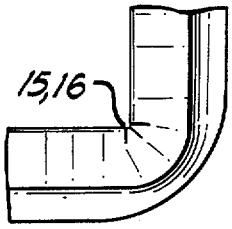
FIG. 7 is a side view of the frame corner formed on the bar in FIG. 5.

When the bar 20 is bent at the region of the cuts 11′ as indicated by arrow 12′ in FIG. 4, the two outermost edges 15, 16 bounding the cuts 11′ abut one another (FIG. 7), and the webs 14 close together. Substantially smooth continuous surfaces are formed on the sides 13 of the corner thus formed. The frame corner and the resulting orientation of the edges 15,16 of the cuts 11′ is shown in FIG. 7.

As an example, for a tubular bar 20 having a wall section 4 about 12 mm wide, the entire axial extent or width C of the cuts 11′ (FIG. 6) is selected to be about 6 mm. The cuts 11′ are each about 1 mm in axial width b, and the webs 14 are each about 1.5 mm in axial width c, providing the total axial width C of the cuts and webs of 6 mm. Since the cuts 11′ are relatively narrow, the bar 20 may be previously filled with desiccant, or filled after making the cuts 11′. The open ends of bar 20 are then plugged, so that the desiccant 19 can not escape. The desiccant is prevented from escaping through the cuts 11′, because of the dimension selected for the axial width b of each of the cuts 11′.

Figure 8:
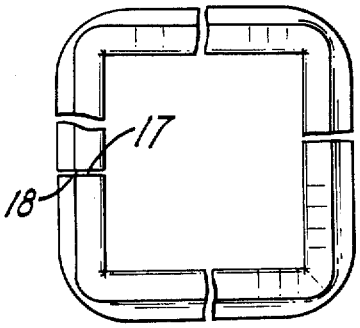
FIG. 8 is a fragmented plan view of a spacing frame which has been formed according to the present invention.

Each set of cuts 11′ is located in the bar 20 so that the ends 17,18 of the bar lie along a straight side of the frame, as shown in FIG. 8. The ends 17,18 can be joined with a simple coupling member or with a suitable part extending between the ends 17,18. Coupling of the ends 17,18 is thus at a portion of the frame which can be easily worked on during the manufacture of an insulating glass assembly. Accordingly, the present invention eliminates the above-mentioned weak points in the prior insulating glass assemblies.

The present invention applies to tubular bars having cross-sections other than that of the bar 20 shown in FIGS. 1–8. FIGS. 9–12 illustrate, for example, tubular bars 22 and 24 each having cross-sections different than that of the bar 20. The bars 22,24 are arranged to contain desiccant or hygroscopic material in their interior regions 26,28 respectively.

Figure 10:
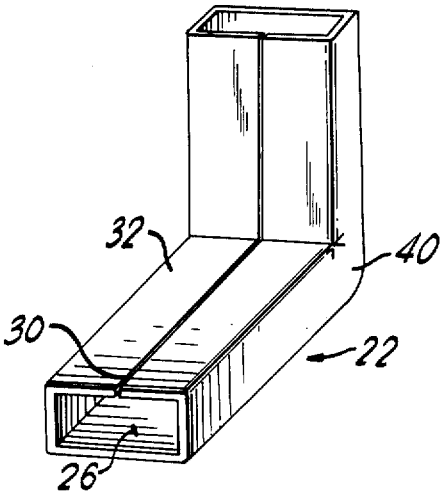
FIG. 10 is a perspective view of the bar in FIG. 9 after it has been bent to form a frame corner.
Figure 9:
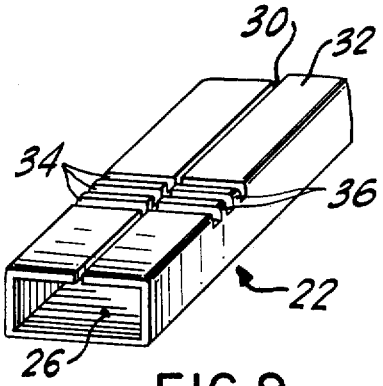
FIG. 9 is a perspective view of part of a second form of tubular bar having a number of cuts therein according to the present invention.

The bar 22 of FIGS. 9 and 10 is formed from a flat metal strip which has been folded into a closed rectangular cross-section by guide rollers. Bar 22 has a slot 30 extending longitudinally and centrally in its wall section 32 which faces the region between the glass panes between which the spacing frame formed by the bar 22 is placed. The slot 30 thus allows desiccant placed within interior region 26 of bar 22 to absorb moisture from the region between the glass panes.

In FIG. 9, the bar 22 has a set of three cuts 34 through its wall section 32, the cuts 34 extending transversely to the longitudinal axis of the bar 22. Webs 36 are thus provided between the cuts 34. The depths of the cuts 34, their axial width, and the axial width of each of the webs 36 is selected as discussed above in connection with the bar 20 of FIGS. 1–8. In FIG. 10, the bar 22 has been bent to form a spacing frame corner, the corner having sides 40 which extend smoothly in the region of the cuts with no bulging.

Figure 12:
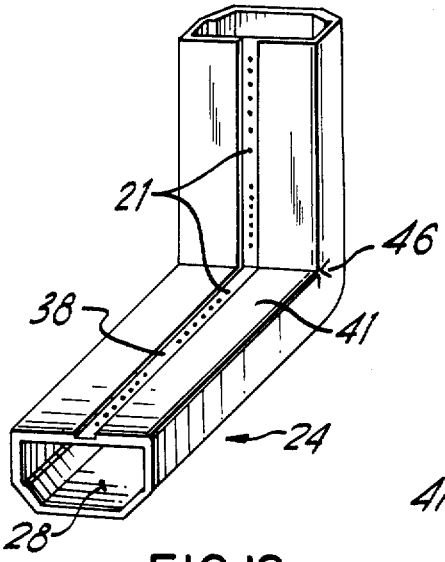
FIG. 12 is a perspective view of the bar in FIG. 11 after it has been bent to form a frame corner.
Figure 11:
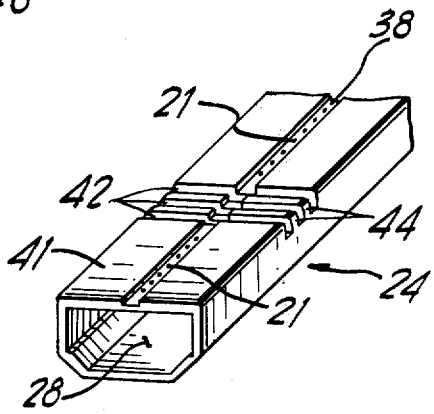
FIG. 11 is a perspective view of part of a third form of tubular bar having a number of cuts therein according to the present invention.

The bar 24 of FIGS. 11 and 12 is drawn from a light metal alloy, the bar 24 having a longitudinally extending recess 38 formed centrally in its wall section 41 which faces the region between the glass panes between which the spacing frame formed by the bar 24 is to be placed. Sets of perforations 21 extending through the wall section 41 are arranged in the recess 38 to enable desiccant placed within the interior region 28 of the bar 24 to absorb moisture from the region between the spaced glass panes. In FIG. 11, the bar 24 has three cuts 42 in its wall section 41, the cuts 42 extending transversely of the longitudinal axis of the bar 24 to provide webs 44 between the cuts 42. The dimensions of the cuts 42 and webs 44 are selected as discussed above in connection with the bar 20 of FIGS. 1–8. In FIG. 12, the bar 24 has been bent to form a frame corner, the corner having sides 46 which are substantially smooth and do not bulge.

The present invention is not limited to spacing frames formed of light metal tubular bars, but can also be successfully applied to bars which are drawn or rolled of, for example, steel. In all cases, the wall section of the bar which faces the region between the glass panes provides a perfect inner border for the glass pane assembly, and the sides of the frame corners remain substantially planar so that the width of the spacing frame remains uniform at these locations. Although the surface of the bar facing away from the region between the glass panes may be deformed at the frame corners, this has not been found to affect the quality or strength of the spacing frame. In fact open regions provided outside the frame corners as a result of deformation of the bar can be filled with sealing compound to further enhance sealing of the glass panes at the frame corners.

While specific embodiments of the invention have been shown and described in detail to illustrate the application of the inventive principles, it will be understood that the invention may be embodied otherwise without departing from such principles.

What is claimed is:

1. A spacing frame for use in forming an insulated arrangement of spaced glass panes so that the frame in combination with the glass panes forms a closed space, comprising a continuous length of a tubular bar having a continuous hollow interior region containing a granular hygroscopic material, said tubular bar including a first wall section forming the inside border of said frame and defining the edges of the closed space, said first wall section having a passage extending in the length direction of said tubular bar for communicating between the closed space and the hollow interior region containing the hygroscopic material, a second wall section forming an outside border of said frame and a pair of side walls extending between said first and second wall sections, said side walls extending substantially integrally at the corners of said frame and forming frame corner sides which are substantially smooth, the inner surfaces of said first wall section, second wall section and side walls forming the hollow interior region, said tubular bar being bent to form said corners, the corners of the spacing frame each comprise a plurality of narrow cuts with opposite parallel surfaces formed in said first wall section and formed between said cuts, said cuts having a depth approximately equal to the thickness of said first wall section so that said cuts open into the hollow interior region and a width in the length direction of said tubular bar equal to or less than the size of the granular hygroscopic material so that the material does not flow through said cuts.

2. A spacing frame, as set forth in claim 1, wherein the width of said cuts and of said webs extending in the length direction of said tubular bar are approximately equal.

3. A spacing frame, as set forth in claim 1 or 2, wherein each corner of the spacing frame has three said cuts.

4. A spacing frame, as set forth in claims 1 or 2, wherein said cuts have a width in the range of 1 to 1.5 mm.

5. A spacing frame, as set forth in claims 1 or 2, wherein said side walls are stepped inwardly toward one another in the direction extending from said first wall section toward said second wall section.

* * * * *

UNITED STATES PATENT OFFICE

CERTIFICATE OF CORRECTION

Patent No. 4,322,926 Dated May 26, 1982

Inventor(s) Hermann Wölflingseder, et al

It is certified that error appears in the above-identified patent and that said Letters Patent are hereby corrected as shown below:

On the title page

In the heading of the Patent [73] should read as follows:

-- [73] Assignee: Seraphin Pümpel & Söhne KG, Feldkirch, Austria --

Signed and Sealed this

***Thirty-first* Day of *August 1982***

[SEAL]

*Attest:*

GERALD J. MOSSINGHOFF

*Attesting Officer* *Commissioner of Patents and Trademarks*